US012312768B2

(12) United States Patent
Cheek et al.

(10) Patent No.: US 12,312,768 B2
(45) Date of Patent: May 27, 2025

(54) REMOVABLE CAB TOE BOX FOR A WORK MACHINE

(71) Applicant: Caterpillar SARL, Geneva (CH)

(72) Inventors: Benjamin Michael Cheek, Cary, NC (US); Rafael dela Rosa, Apex, NC (US); Sage Frederick Smith, Charlotte, NC (US)

(73) Assignee: Caterpillar SARL, Geneva (CH)

( * ) Notice: Subject to any disclaimer, the term of this patent is extended or adjusted under 35 U.S.C. 154(b) by 344 days.

(21) Appl. No.: 17/823,833

(22) Filed: Aug. 31, 2022

(65) Prior Publication Data

US 2023/0089881 A1 Mar. 23, 2023

Related U.S. Application Data

(60) Provisional application No. 63/245,777, filed on Sep. 17, 2021.

(51) Int. Cl.
*E02F 9/16* (2006.01)
*E02F 3/34* (2006.01)

(52) U.S. Cl.
CPC ..... *E02F 9/166* (2013.01); *E02F 3/3414* (2013.01)

(58) Field of Classification Search
CPC ... E02F 9/166; B62D 33/067; B62D 33/0617; B62D 33/0625; B62D 25/24
USPC .... 296/190.05, 190.08, 190.04, 190.01, 191, 296/193.03, 75; 180/89.12, 89.13, 89.14, 180/89.18, 90.06
See application file for complete search history.

(56) References Cited

U.S. PATENT DOCUMENTS

| | | | | |
|---|---|---|---|---|
| 2,298,773 | A * | 10/1942 | Nicol | B62D 33/04 180/89.18 |
| 2,781,102 | A * | 2/1957 | Prichard | B62D 49/005 180/69.2 |
| 5,941,330 | A | 8/1999 | Miller et al. | |
| 6,860,707 | B2 | 3/2005 | Roan et al. | |
| 7,401,848 | B2 | 7/2008 | Haboon et al. | |
| 7,744,148 | B2 | 6/2010 | Jones et al. | |
| 7,975,793 | B1 * | 7/2011 | Claas | B60N 2/24 296/190.05 |
| 8,038,379 | B2 * | 10/2011 | Yamashita | E02F 9/166 180/89.18 |
| 9,982,413 | B2 | 5/2018 | Paolini et al. | |
| 10,000,244 | B2 * | 6/2018 | Knutson | B62D 33/0617 |

(Continued)

FOREIGN PATENT DOCUMENTS

| | | | | |
|---|---|---|---|---|
| WO | WO-2007012398 A1 * | 2/2007 | | B62D 21/15 |
| WO | WO-2007012400 A1 * | 2/2007 | | B62D 21/152 |
| WO | 2021178441 A2 | 9/2021 | | |

OTHER PUBLICATIONS

European Extended Search Report for EP Application No. 22195529.7, mailed Feb. 10, 2023 (6 pgs).

*Primary Examiner* — Amy R Weisberg
*Assistant Examiner* — Wenwei Zhuo

(57) ABSTRACT

Removable cab toe boxes are described herein to provide increased comfort to an operator while still allowing a cab to be rotated upwards to provide access to equipment below the cab. The removable toe boxes are removably affixed to the cab and, when installed, may provide at least a partial seal to prevent or reduce the amount of dirt or dust entering the cab. When the toe boxes are removed, equipment may move through the space created from the removal of the toe boxes to allow the cab to rotate.

20 Claims, 11 Drawing Sheets

(56) References Cited

U.S. PATENT DOCUMENTS

| | | | | |
|---|---|---|---|---|
| 2007/0145779 | A1 | 6/2007 | Jones et al. | |
| 2007/0145780 | A1 | 6/2007 | Tecklenburg et al. | |
| 2008/0106122 | A1* | 5/2008 | Grimes | B62D 33/067 16/386 |
| 2020/0023789 | A1 | 1/2020 | Erhardt et al. | |
| 2021/0270004 | A1* | 9/2021 | Durkin | E02F 3/422 |

* cited by examiner

REMOVABLE CAB TOE BOX FOR A WORK MACHINE

CROSS REFERENCE TO RELATED APPLICATIONS

This application claims the benefit of U.S. Provisional Application No. 63/245,777 filed Sep. 17, 2021, entitled "Removable Cab Toe Box for a Work Machine", which is incorporated herein by reference in its entirety.

TECHNICAL FIELD

The present disclosure relates to a work machine having a cab. More specifically, the present disclosure relates to work machine, such as a skid steer loader or a compact track loader, having removable toe boxes that allow for the rotation of the cab for access to equipment.

BACKGROUND

Compact loaders, such as skid steer loaders (SSL) or compact track loaders (CTL), are relatively small work machines that can provide a variety of lifting and moving functions in tight spaces. Well balanced and highly maneuverable, compact loaders often are used in rugged outdoor environments, such as with heavy construction or mining. A compact loader has lift arms that pivot on left and right sides of the frame and a work tool such as a shovel manipulated by the lift arms. Wheels or tracks that may be separately driven, combined with the relatively small size of the loader, contribute to the high maneuverability of the machine. An operator cab is centered or somewhat forward on a frame where an operator controls the compact loader. A conventional SSL/CTL includes a cab with a sheet metal (or other sturdy material) floor to support the operator's seat and feet. A fully-enclosed (or sealed), rotatable machine cab can provide advantages over conventional skid steer loaders.

A cab of an SSL/CTL may need to be moved in some manner to allow for the inspection or maintenance of equipment located underneath the cab. A first design may be a two-part cab which improves the foot space by rotating the portion of cab above the tilt cylinder and the floor area stays in place. However, the two-part cab has disadvantages such as blocking service access for components underneath the floor area and reduced sealing performance. A second design includes tilting of the cab from the front. This geometry makes service access more difficult. Generally, the lift arms are required to raise prior to tilting the cab.

An example of a conventional cab system may be found in U.S. Pat. No. 10,000,244 (the '244 patent). In particular, the '244 patent describes a vehicle with a "pod" that can be rotated between an open and closed position. For example, FIG. 3 of the '244 patent shows the pod in a fully rotated or open position, whereas FIG. 1 of the '244 patent shows the pod in a fully closed position. In the case of a tilt-able cab, the use of tilt cylinders, along with the geometry of the SSL/CTL cabs in general, may limit the interior dimensions of the cab itself.

Examples of the present disclosure are directed to overcoming deficiencies of such systems.

SUMMARY

In some examples, a machine is described. The machine includes a frame defining a horizontal axis and a vertical axis for the work machine, the frame having a left side and a right side with respect to a direction of forward travel of the work machine, traction devices coupled to the left side and the right side of the work machine, a lift arm pivotably attached to the frame through a linkage, a lift arm cylinder pivotably attached to the lift arm and the frame, the lift arm cylinder when extended causing the lift arm to move to a lifted position and when retracted causing the lift arm to move to a lowered position, a cab rotatably attached to the frame through a hinge, wherein the cab is rotatable from a closed position to an open position, and at least one toe box removably affixed to a portion of the cab, wherein when the toe box is detached from the cab, the cab is rotatable from the closed position to the open position without contacting an exterior portion of the lift arm cylinder.

In another example, a cab for use in a machine is described. The cab includes a left side wall, a right side wall, a ceiling, a floor, wherein the left side wall, the right side wall, the ceiling, and the floor provide an interior of the cab, and a toe box removably affixed to the floor of the cab.

In a still further example, a toe box for use in a cab of a machine is described. The toe box includes, a side wall, a front wall connected to a front wall, the front wall extending normally from a distal end of the side wall, and a lip continuously extending out from the side wall and the front wall to provide a location to removably affix the toe box to the cab.

DETAILED DESCRIPTION

Figure 1:
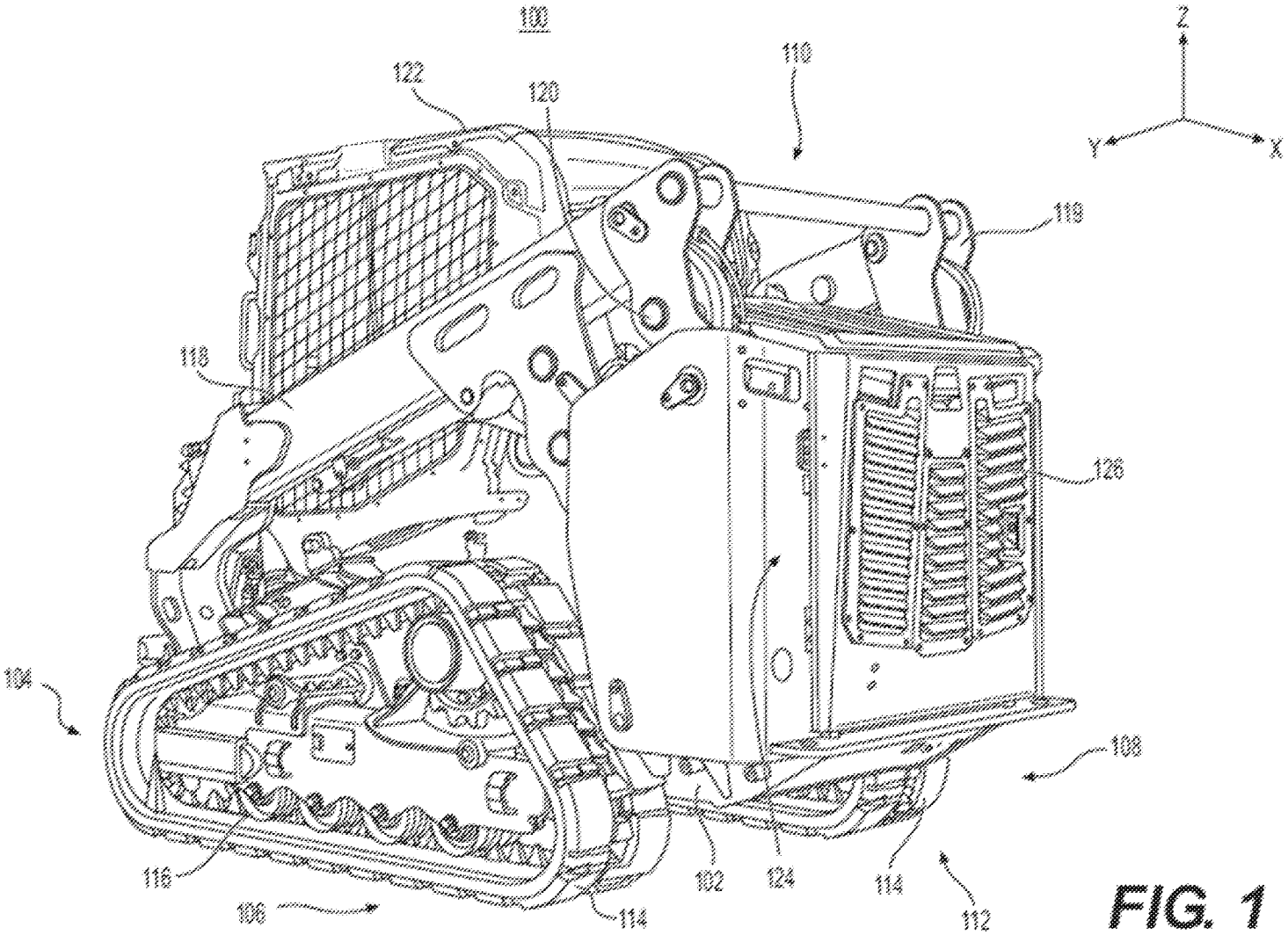
FIG. 1 illustrates an isometric view of a work machine, in accordance with an example of the present disclosure.

Wherever possible, the same reference numbers will be used throughout the drawings to refer to the same or like parts. FIG. 1 illustrates an isometric view of a work machine 100 within an XYZ coordinate system as one example suitable for carrying out the principles discussed in the present disclosure. Work machine 100 is illustrated in FIG. 1 as a compact track loader, although work machine 100 may be any type of compact loader known in the field by a variety of names, such as a skid steer loader, tracked skid steer loader, multi-terrain loader, etc. Often the terminology applied to work machine 100 turns on the form of traction of the machine, with skid steer loaders having wheels with tires and tracked skid steer loader machines or multi-terrain loader machines utilizing an endless track undercarriage to provide greater traction in mud, snow, ice and the like. As discussed further below, the form of traction for work machine 100 is not material to the examples described, and "compact loader" is used generically to refer to the overall class of loaders.

Similarly, the term "machine" as used in this disclosure refers to any machine that performs some type of work operation associated with an industry, such as mining, construction, farming, landscaping, or transportation. Compact loaders, such as a compact track loader as illustrated for work machine 100, may perform many work functions across a range of industries. The principles of this disclosure could be applied to other machines having more focused capabilities, such as a wheel loader, excavator, dump truck, backhoe, motor grader, material handler or the like.

As generally embodied in FIG. 1, work machine 100 includes a body or frame 102, that houses and supports a variety of components and assemblies. Work machine 100 travels in a forward direction from right to left along the X-axis in FIG. 1, such that for purposes of reference, the sides of work machine 100 are generally denoted as front side 104, left side 106, right side 108, top side 110, and rear side 112. For purposes of illustration and reference, and in general, front side 104 and rear side 112 are depicted in the Y-Z plane, left side 106 and right side 108 are shown in the X-Z plane, and top side 110 is positioned in the X-Y plane.

Work machine 100 includes continuous tracks 114 on its left side 106 and right side 108 that rotationally propel the machine. A set of wheels 116 is enclosed by, and at least some of those wheels are engaged with, tracks 114 and causes tracks 114 to rotate and move work machine 100. Work machine 100 can cause tracks 114 to operate at multiple speeds and in a forward and a reverse direction. Tracks 114 are independently controlled and activated, thereby enabling turning of work machine 100 outside of a linear path, often within a small radius, and providing overall skid-steering maneuverability.

In addition, a pair of lift arms 118 are pivotably attached to frame 102 through a linkage 119 and extend longitudinally in the X-axis on both left side 106 and right side 108 of work machine 100. Lift arms 118 rotate in conjunction with linkage 119 around pivot points 120 near the top side 110 to provide a raising and lowering action for the front of lift arms 118. Although not shown in the figures, lift arms 118 support a work tool at their ends at front side 104 of work machine 100 for executing a work function. The work tool may be any item for assisting in executing a function, typically a loader or bucket. Any other tool could alternatively be attached depending on the need, such as a pallet fork, broom, grinder, tiller, rake, blade, or auger. The lift arms 118 may be raised or lowered using one or more lift arm cylinders, as described in more detail in FIG. 2. The lift arms 118 include other ancillary components to assist with their operation that are not discussed in FIG. 1 solely for purposes of simplicity, such as lift linkages, power trains, hydraulic pumps, motors, valves, hydraulic lines, and a hydraulic tank.

As shown in FIG. 1, work machine 100 includes an operator cabin, or cab 122, positioned somewhat forward toward front side 104 on frame 102. Cab 122 is situated between lift arms 118 and includes a seat and various controls and electronics for operating work machine 100. The controls and electronics may include a plurality of devices, such as joysticks, pedals, levers, user interfaces, and other types of display and input devices to control various operations associated with work machine 100, such as controlling lift arms 118 and independently activating the tracks 114. The cab 122 typically is surrounded by a cage to provide protection for an operator seated within while enabling adequate visibility to the surroundings. The cab 122 may have a rear window or opening to provide visibility behind the operator from within the cab 122.

Work machine 100 also includes an engine compartment 124 that is rear mounted on frame 102. By "rear mounted," it is meant that engine compartment 124 is positioned closer to rear side 112 of work machine 100 than to front side 104. More specifically, engine compartment 124 is mounted behind the cab 122, along the X-axis as in FIG. 1, relative to front side 104 of work machine 100. An engine not shown in FIG. 1 is housed within engine compartment 124 and has substantial weight relative to the rest of work machine 100. By being rear mounted toward rear side 112 in work machine 100, engine compartment 124 helps provide ballast and may counterbalance a heavy load imparted by or on a work tool attached to lift arms 118 at front side 104 of work machine 100.

A grille 126 is positioned along a back wall of at least a portion of engine compartment 124 at a rear side 112 of work machine 100. Grille 126, representatively shown in FIG. 1 with slats or louvers, may include a framework or structure for covering rear side 112 of engine compartment 124 while still allowing the passage of air therethrough. As discussed in more detail below for some examples, air is drawn through grille 126 to help cool engine compartment 124, although an ejection of air through grille 126 is also possible for other examples.

While FIG. 1 depicts an exterior of work machine 100 from a perspective of the left rear corner of the machine, FIGS. 2-9 illustrate more detailed views of work machine 100 relative to the present disclosure. The following discussion refers interchangeably between the different perspectives of work machine 100 shown in FIGS. 2-9.

Figure 2:
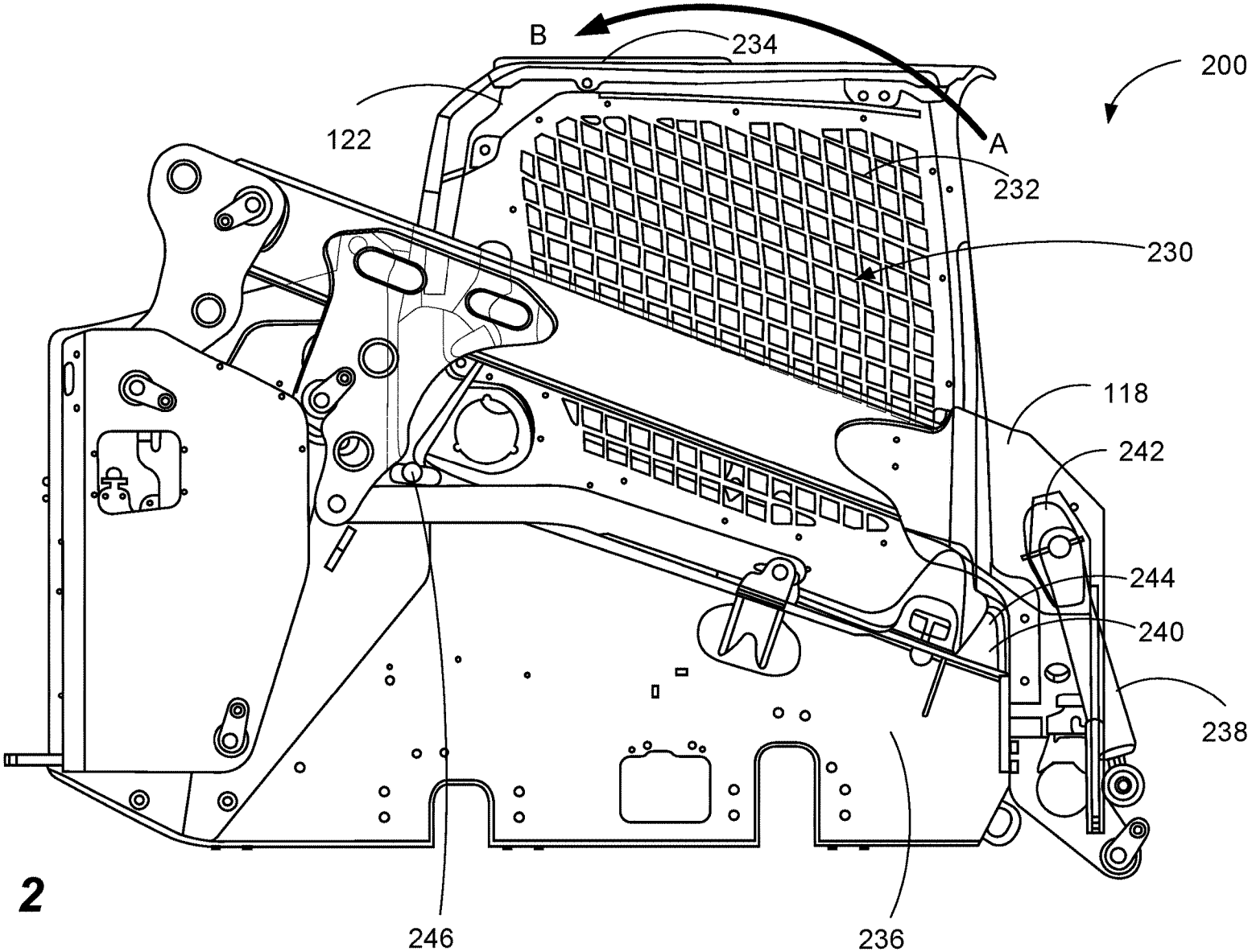
FIG. 2 is a side view of a cab structure used in a machine, in accordance with one or more examples of the presently disclosed subject matter.

FIG. 2 is a side view of a cab assembly 200 of the work machine 100 of FIG. 1. As illustrated in FIG. 2, the cab assembly 200 includes the cab 122. The cab 122 is typically used as the location in which an operator (not shown) would be in order to operate a machine. The cab 122 can be a fully enclosed space, whereby the environment in the cab 122 is climate controlled and is at least partially separated from the exterior of the cab 122, or, the cab 122 may be partially or fully open to the environment in the exterior of the cab 122. An interior space 230 of the cab 122 includes side walls, such as side wall 232, a ceiling 234, and a floor (shown by way of example in FIG. 6). The presently disclosed subject matter is not limited to any particular environment within or external to the cab 122.

The cab assembly 200 may further include a support structure 236 of the frame 102. As used herein, the support structure 236 is part of the frame 102 and may be used interchangeably. The support structure 236 of the frame 102 provides an installation location upon which the cab 122 and other equipment described herein may be rotatably affixed. The cab assembly 200 further includes the lift arm 118 that is movably attached to the support structure 236. The lift arm 118 may be mated to one or more devices such as a backhoe, bucket, extended arms for loading items such as crates or equipment, and the like to perform a function. A lift arm cylinder, such as cylinder 238, may be used to manipulate devices connected to the lift arm 118. The cylinder 238 is a hydraulic or pneumatic cylinder and is pivotably attached to the lift arm and the frame of the work machine 100. Retracting or extending the cylinder 238 in response to an operator input performs functions such manipulation of a bucket, the lift arm 118 itself, and other functions depending on the configuration of the work machine 100. The presently disclosed subject matter is not limited to any particular equipment or configuration of the lift arm 118 or the cylinder 238.

The cab 122 further includes a toe box 240, which will be described in more detail below. The toe box 240 is a removably affixed portion of the cab 122 that, when installed, provides an operator with additional space within the interior space 230 of the cab 122 near the area in the interior space 230 of the cab 122 in which the operator's feet are positioned. The toe box 240 extends out from the cab 122 to provide that additional space. However, by extending out from the cab 122, the toe box 240 may block the movement of the cab 122 past an exterior portion 242 of the cylinder 238 proximate to an exterior portion 244 of the toe box 240. If installed on the cab 122 when the cab 122 is rotated, the exterior portion 244 of the toe box 240 may impinge or impact the exterior portion 242 of the cylinder 238.

In various examples disclosed herein, and as indicated by the arc AB shown in FIG. 2, the cab 122 is rotatable about a hinge 246 in the direction of A to B while the remaining structures, such as the lift arm 118, support structure 236, and the cylinder 238 remain stationary, illustrated in further detail in FIGS. 3-5, below. In some examples, the hinge 246, located on one side of the cab 122 and a corresponding hinge (not shown) located on the other side of the cab 122, rotatably connect the cab 122 to the support structure 236. It should be noted that the location of the hinge 246 as illustrated in FIG. 2 is merely exemplary and not intended as a limitation, as other rotational locations may be used and would be considered within the scope of the presently disclosed subject matter.

Figure 3:
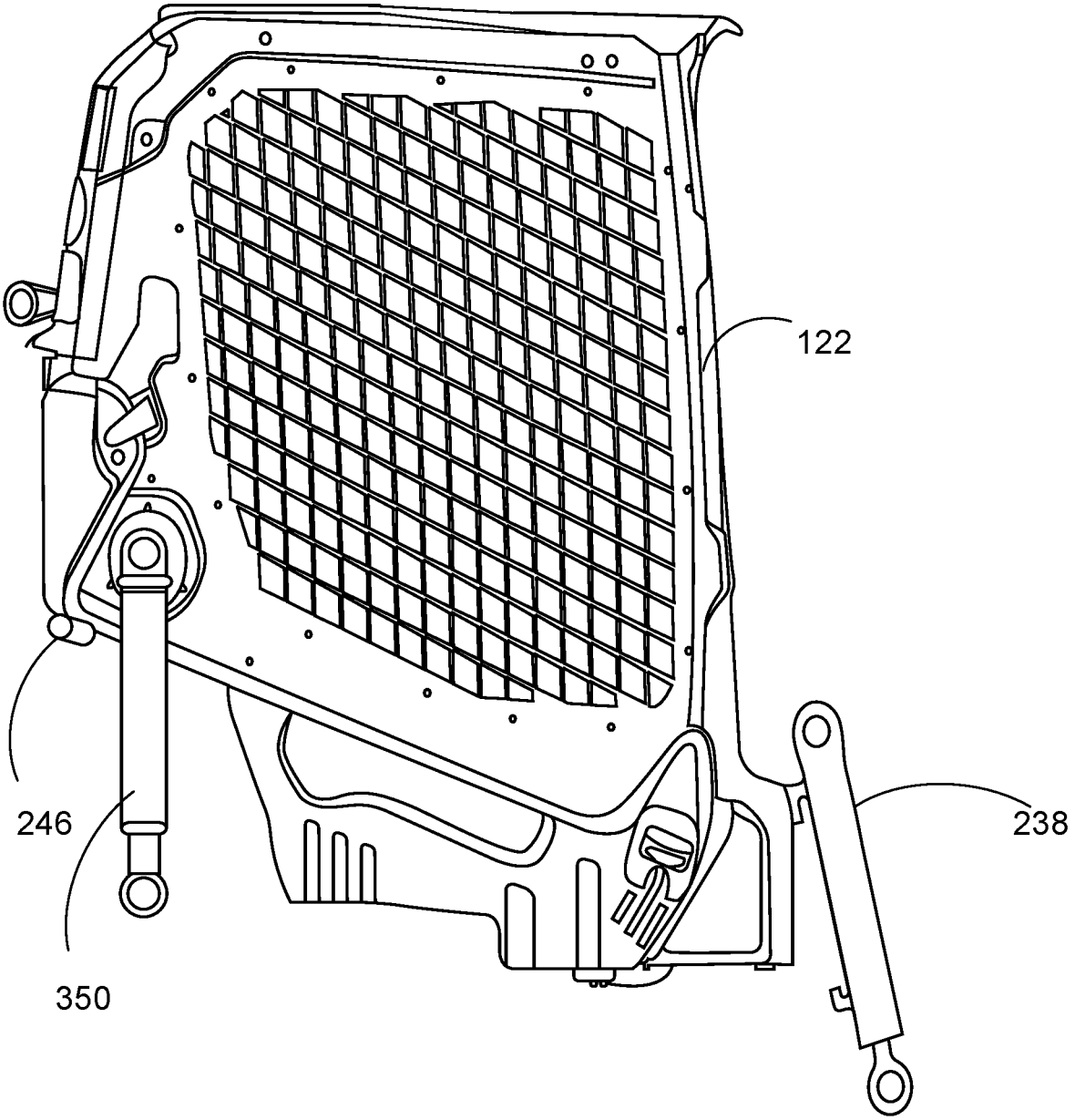
FIGS. 3-5 are side views of the cab structure showing the rotation of the cab past a cylinder, in accordance with one or more examples of the present disclosure.
Figure 4:
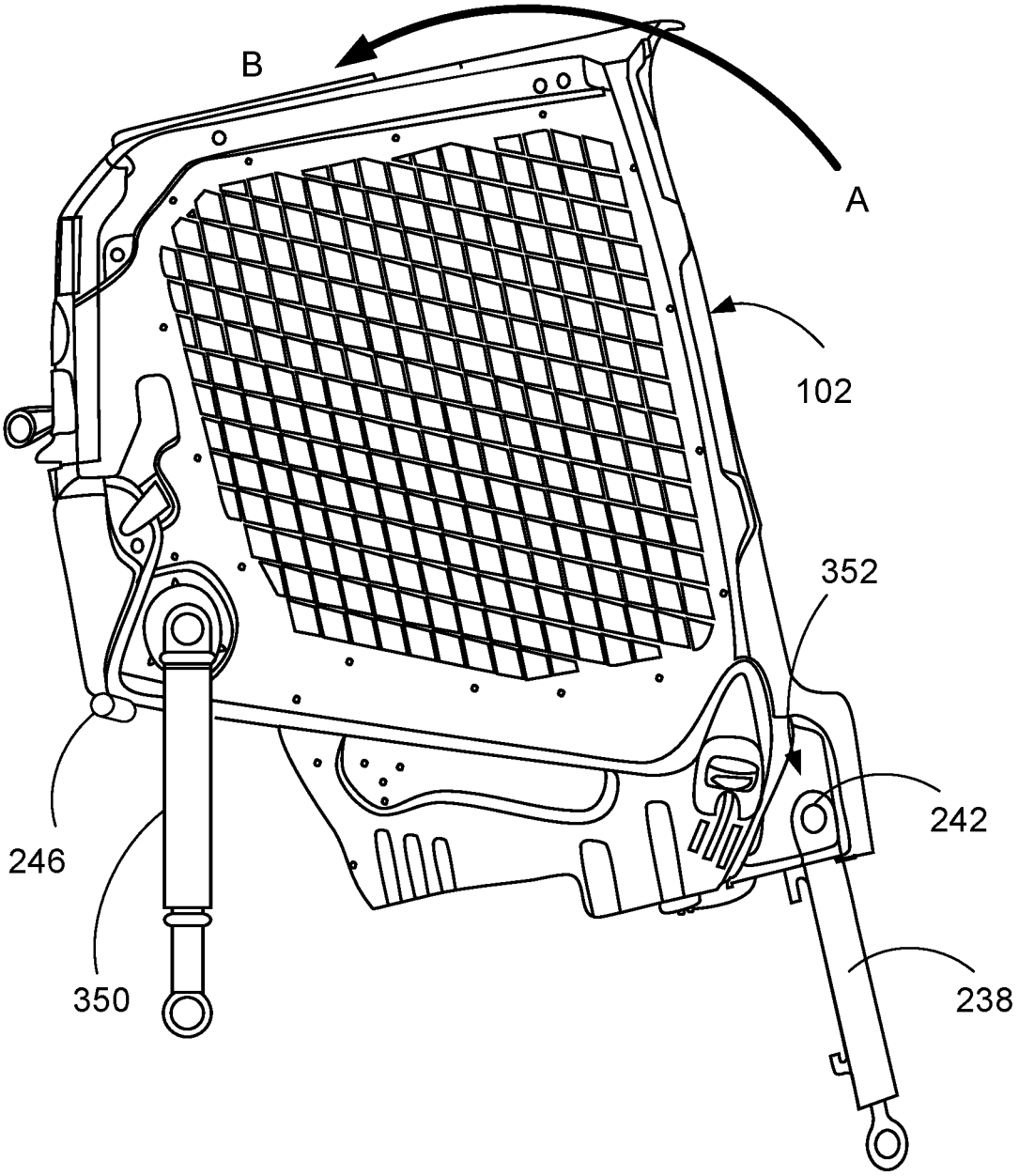
Figure 5:
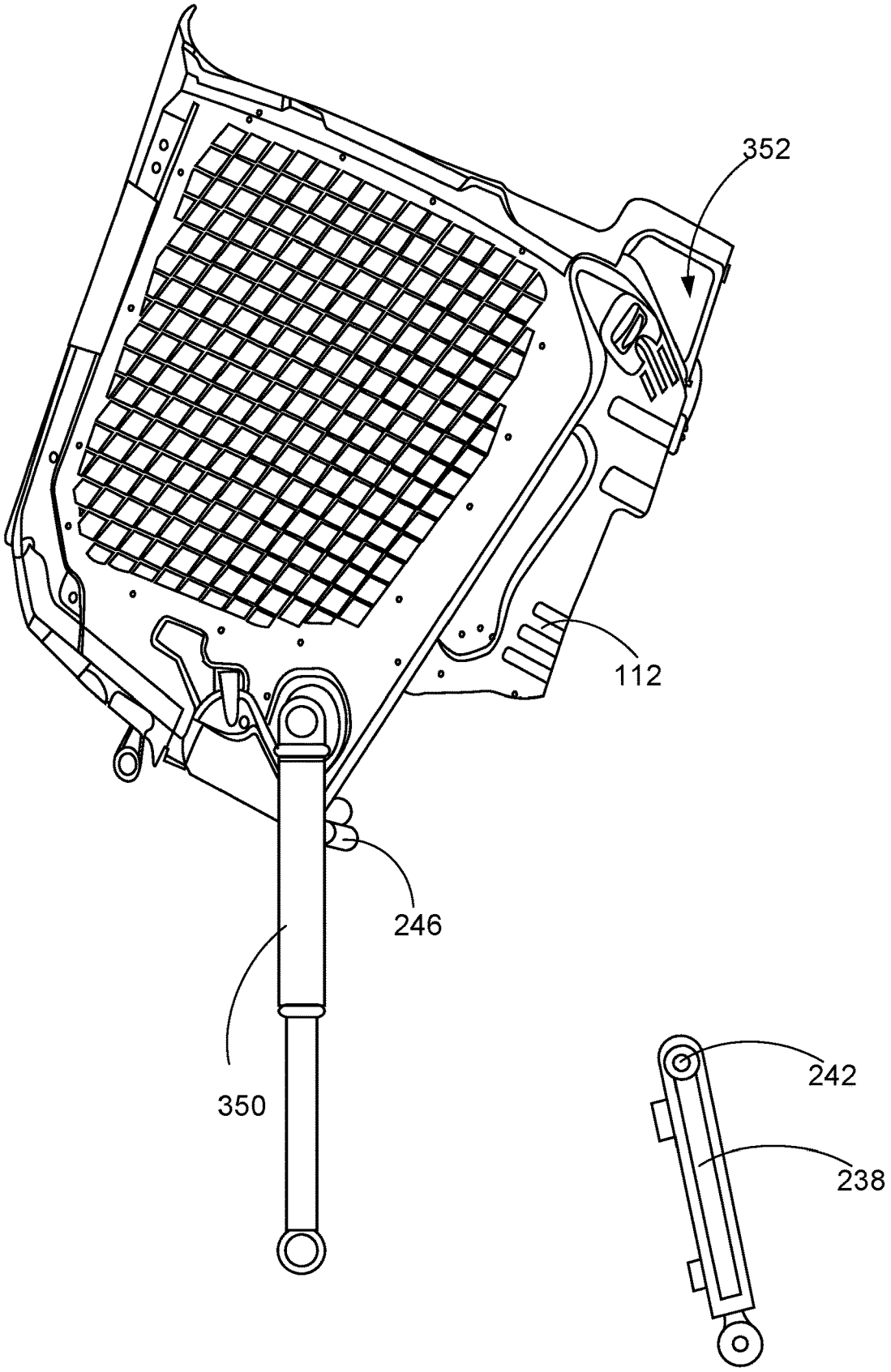

FIGS. 3-5 are side views of the cab 122 showing the rotation of the cab 122 using the hinge 246. The cab 122 includes a cab lift cylinder 350 pivotably connected to the cab 122 and the support structure 236. Also illustrated is cylinder 238. The cab lift cylinder 350, in some configurations, maintains the cab 122 in a rotated position. In some configuration, the cab lift cylinder 350 provides a motive force to assist the operator with rotating the cab 122. The cab 122 in FIG. 3 is in a closed or operational position. The closed or operational position is typically the position of the cab 122 when work machine 100 is being operated.

In FIG. 4, the cab 122 is slightly rotated in the direction of A to B from the closed or operational position into a transitional position. As illustrated, the cab lift cylinder 350 is slightly extended and an area 352 in which the toe box 240 would be installed is in transition to move past the exterior portion 242 of the cylinder 238. In FIG. 5, the cab 122 is fully rotated to an open position. The cab lift cylinder 350 is extended and the hinge 246 is fully open. The area 352 in which the toe box 240 would be installed is fully past the exterior portion 242 of the cylinder 238. As can be seen from FIGS. 2 and 3-5, if the toe box 240 was installed on the cab 122, the exterior portion 244 of the toe box 240 impinges or impact the exterior portion 242 of the cylinder 238. Thus, while the installation of toe boxes in the cab 122 provides comfort to the operator, for example, when installed, the toe boxes prevent the rotation of the cab 122, described in more detail in FIGS. 6-11, below.

Figure 6:
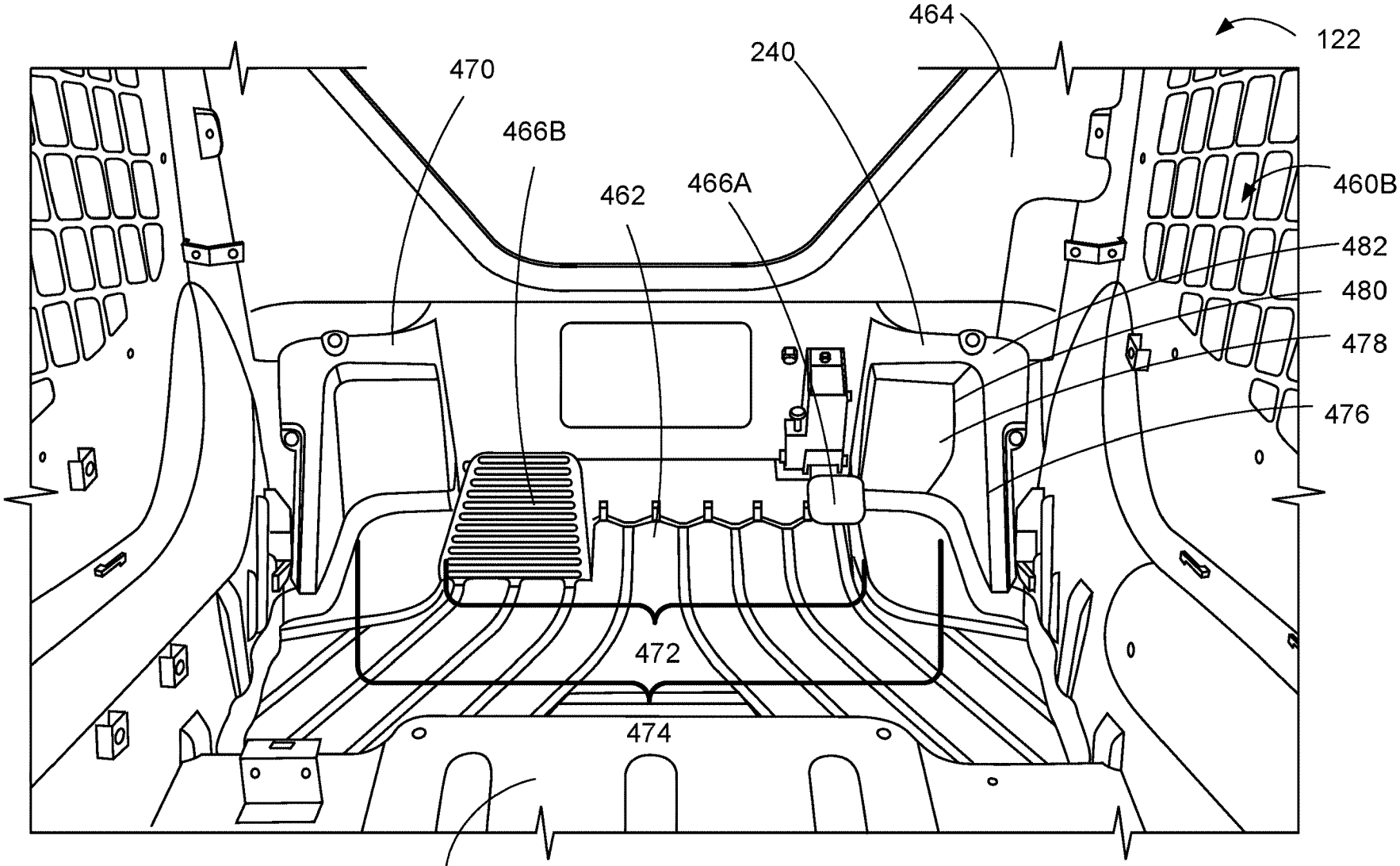
FIG. 6 illustrates an interior space of a cab, in accordance with one or more examples of the present disclosure.

FIG. 6 illustrates the interior space 230 of the cab 122. As illustrated, the cab 122 includes a left side wall 460A and a right side wall 460B. The left side wall 460A and/or the right side wall 460B may be solid or may include one or more vents. The cab 122 further includes a floor 462 generally normal and between to the left side wall 460A and the right side wall 460B. Along with a rear wall (not shown) opposite and parallel to a front wall 464, the left side wall 460A, right side wall 460B, and the floor 462 are connected to form the interior space 230. The floor 462 is a lower portion of the cab 122 that allows for a solid or semi-solid (typically rigid) surface upon which the operator may place his or her feet or other items during use. The cab 122 further includes a first operating pedal 466A and a second operating pedal 466B. The first operating pedal 466A may be used as an input to provide a first set of functions and the second operating pedal 466B may be used as an input to provide a second set of functions. For example, depressing the first operating pedal 466A, in some configurations, causes the continuous tracks 114 to rotate to propel the work machine 100.

The first set of functions and the second set of functions may be programmable and modifiable based on the configuration of the machine with which the cab 122 is used. For example, the first operating pedal 466A may be programmed to move the machine forward or backward and the second operating pedal 466B may be used to tilt or manipulate the lift arms 118. It should be noted that the presently disclosed subject matter is not limited to any particular functional configuration of the first operating pedal 466A or the second operating pedal 466B, or, require that the first operating pedal 466A or the second operating pedal 466B provide any functionality. For example, the second operating pedal 466B may be a stationary surface upon which an operator's foot may rest. The cab 122 may further include a seat module 468 upon which a seat for use by the operator may be attached to allow the operator to sit down during the operation of the machine.

As noted above, the use of toe boxes, such as the toe box 240 and a corresponding toe box 470 can extend the space available to an operator. This additional space is illustrated in FIG. 6 by lengths 472 and 474. Length 472 is an approximate length normally available to an operator without the use of removable toe boxes 240 and 470. Unless the toe boxes 240 and 470 are removable, the interior space 230 of the cab 122 proximate to an operator's feet can only extend to length 472 in order to provide the necessary clearance to allow the cab 122 to rotate past the exterior portion 242 of the cylinder 238. However, with the toe boxes being removably affixed to the cab 122, the interior space 230 of the cab 122 proximate to an operator's feet can be extended from the length 472 to the length 474, thus providing additional foot space. Having length 474 rather than length 472 available provides various benefits. For example, the first operating pedal 466A is spaced further apart from the second operating pedal 466B, increasing ease of use, comfort, and reducing the probability of inadvertently depressing the wrong pedal. Further, allowing the operator the additional length provided by the length 474 over the length 472 can increase operator comfort while reducing operator fatigue, in various examples.

The shape and form of the toe boxes 240 and 470 are configured to allow for additional space for the operator's feet and other equipment, such as the first operating pedal 466A and the second operating pedal 466B. For example, the toe box 240 includes a side wall 476 connected to a front wall 478 extending normally from a distal end 480 of the side wall 476. The front wall 478 of the toe box 240 may be shaped to extend further past the front wall 464 of the cab 122 to provide additional space, as illustrated in FIG. 6. The toe box 240 further includes a lip 482 continuously extending out from the side wall 476 and the front wall 478 to provide a connection location to removably affix the toe box 240 to the interior space 230 of the cab. The toe box 240 may be removably affixed using various components such as screws, tabs, clamps, buttons, clasps, and the like. The presently disclosed subject matter is not limited to any particular method of removably securing the toe box 240 to the cab 122. The toe box 470 is similarly configured.

Figure 7:
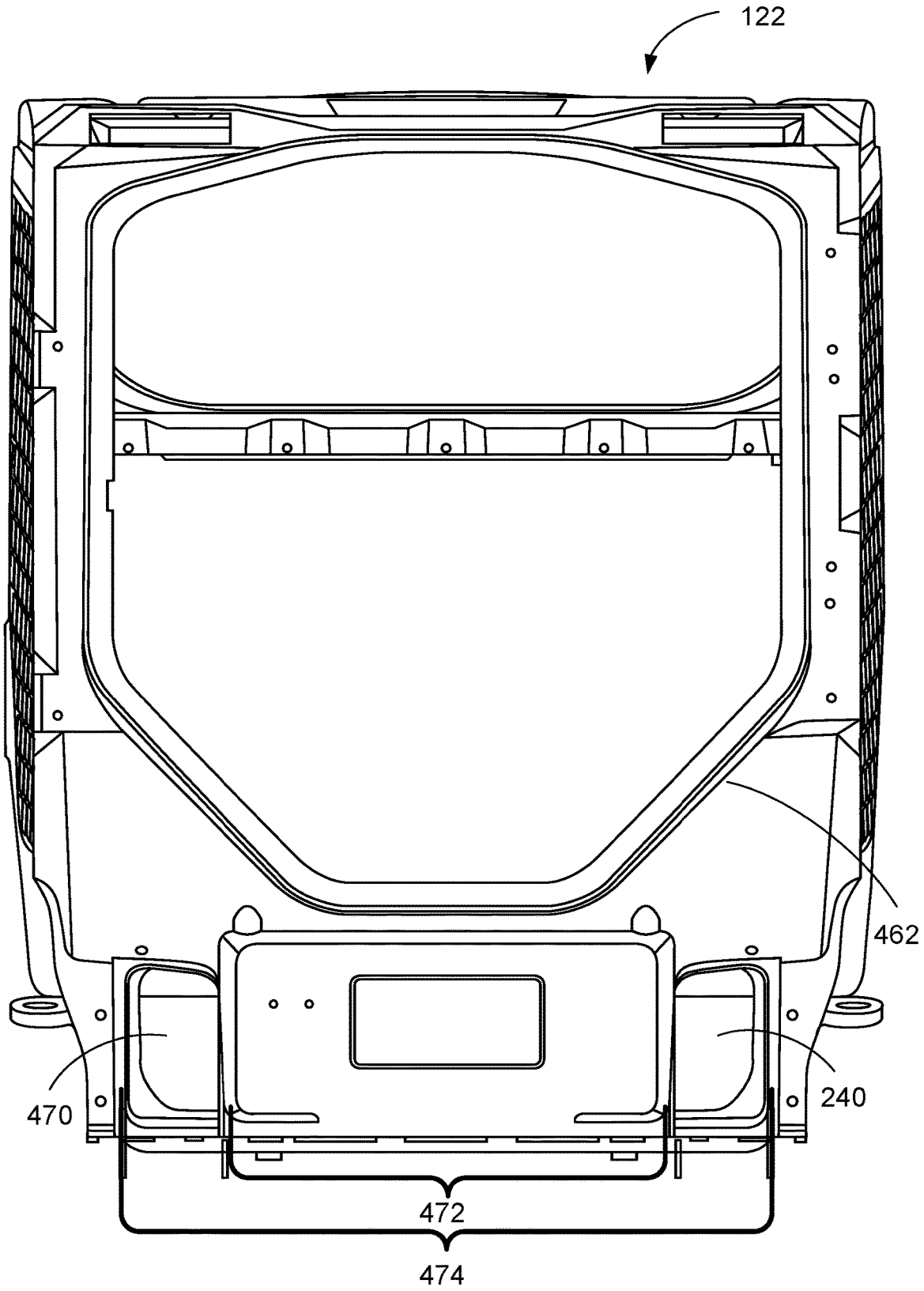
FIG. 7 is an illustration of an underside of a floor of a cab showing toe boxes installed, in accordance with one or more examples of the present disclosure.

FIG. 7 is an illustration of the underside of the floor 462 of the cab 122 showing the toe box 240 and the toe box 470 installed. The toe box 240 and the toe box 470 are removably installed onto the floor 462 of the cab 122. Also illustrated in FIG. 7 are lengths 472 and 474. As mentioned previously, providing a removable toe box, such as the toe boxes 240 and 470, can increase the amount of floor space available for an operator of a machine. Without the removable toe boxes 240 and 470, in order to provide space to allow the cab 122 to tilt past a tilt arm cylinder, such as cylinder 238 of FIG. 2, the cab 122 would need to be configured so to that cab 122 length near the feet of the operator was approximately the length 472. However, because the toe boxes 240 and 470 are removable, during operation, the length of the cab 122 near the feet of the operator can be extended out to the length 474. This additional length, which can be several inches in some configurations, can provide for a more comfortable foot position for the operator, potentially reducing fatigue and increasing safety.

Figure 8:
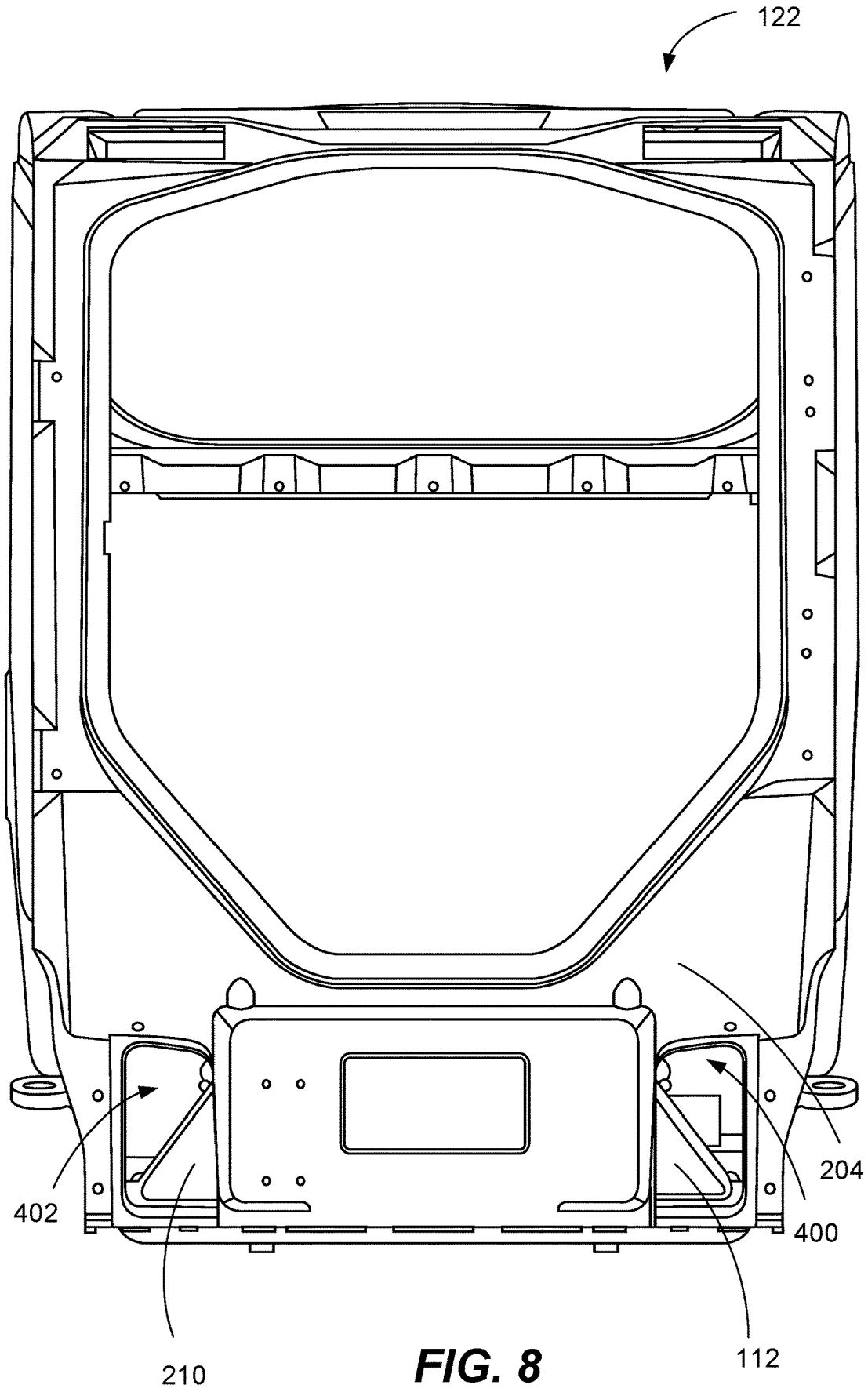
FIG. 8 is an illustration of an underside of a floor of a cab showing toe boxes removed from their respective affixed positions, in accordance with one or more examples of the present disclosure.

FIG. 8 is an illustration of the underside of the floor 462 of the cab 122 showing the toe box 240 and the toe box 470 removed from their respective affixed positions. As shown in FIG. 8, the removal of the toe box 240 and the toe box 470 provide the clearance needed to allow the cab to rotate past the exterior portion 242 of the cylinder 238, illustrated in FIGS. 3-5, above.

Figure 9:
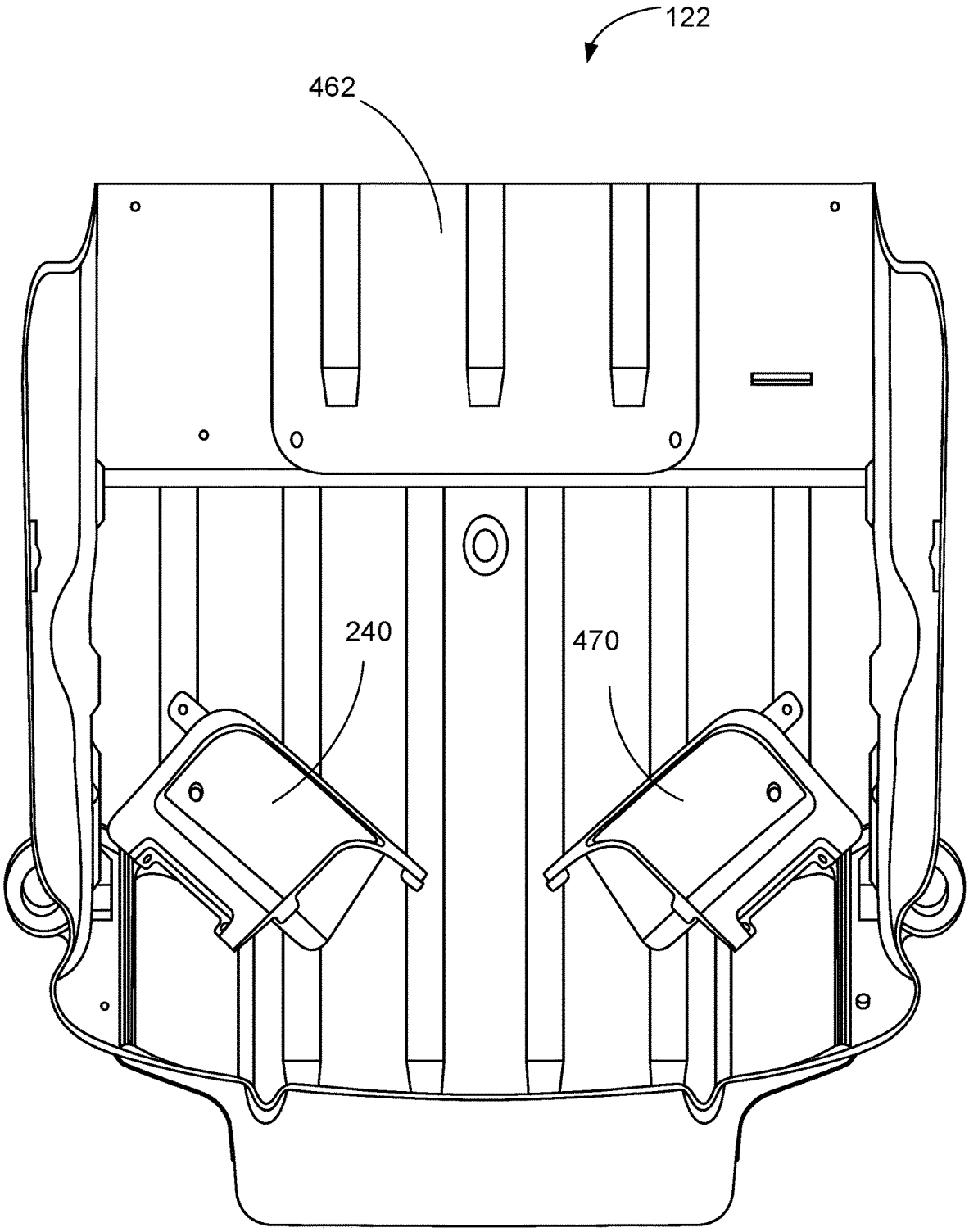
FIG. 9 illustrates a topside of a floor of a cab showing toe boxes removed and placed on a floor of a cab, in accordance with one or more examples of the present disclosure.

FIG. 9 illustrates the topside of the floor 462 of the cab 122 showing the toe boxes 240 and 470 removed and placed on the floor 462 of the cab 122. As will be described in more detail below in FIG. 10, when detached from the cab 122, the toe boxes 240 and/or 470 may be completely detached or affixed in some manner to prevent the accidental loss of the toe boxes 240 and/or 470.

Figure 10:
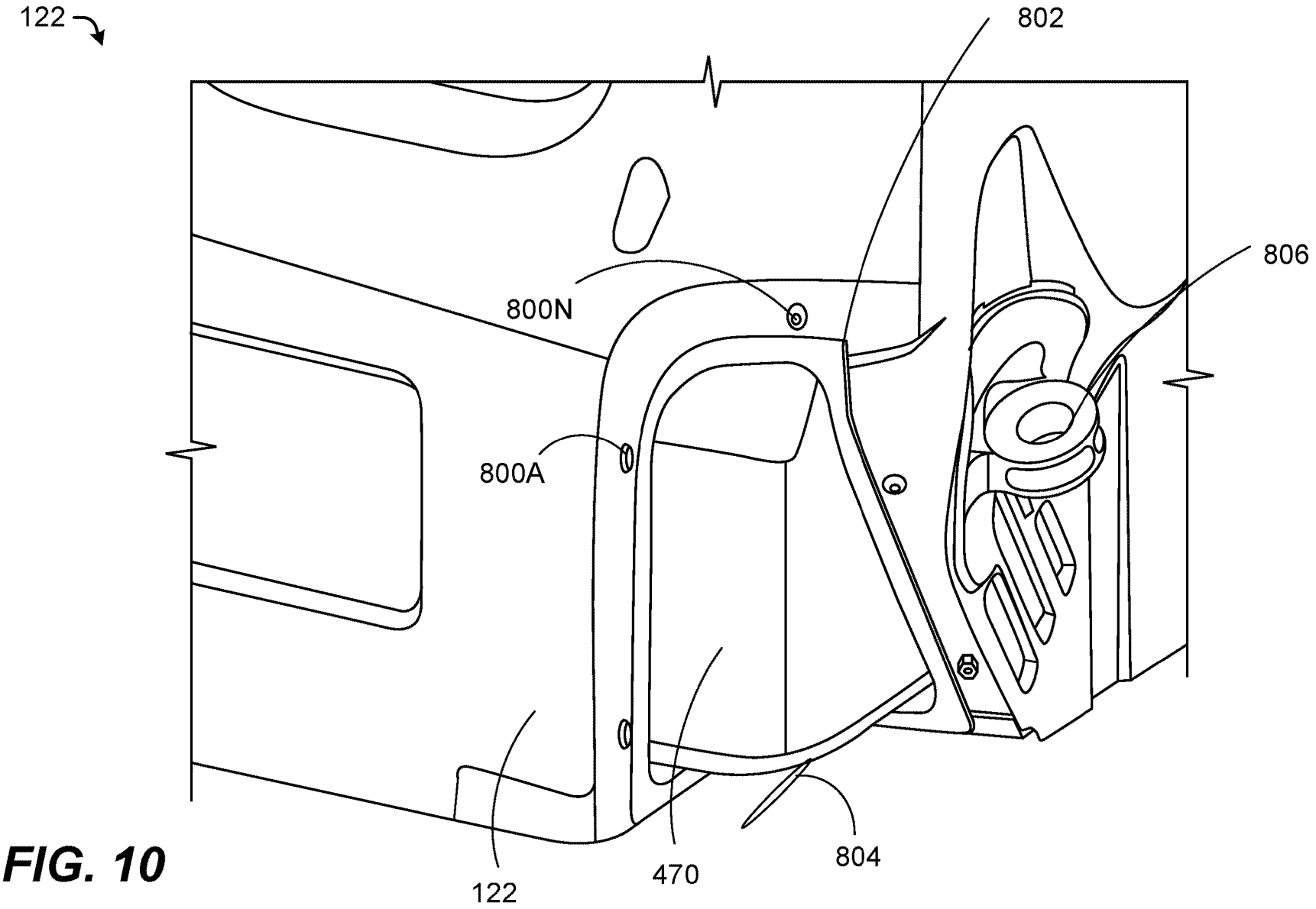
FIG. 10 is a close-up illustration of a toe box affixed to a cab, in accordance with one or more examples of the present disclosure.

FIG. 10 is a close-up illustration of the toe box 470 affixed to the cab 122. As shown in FIG. 10, the toe box 470 is removably affixed to the cab 122. In the example illustrated in FIG. 10, the toe box 470 is removably affixed using screws 800A-800N. It should be noted that the presently disclosed subject matter is not limited to any particular technology for removably affixing the toe box 470 to the cab 122. Further, the number of screws 800A-800N is merely for purposes of illustration and not intended as a limitation. As mentioned previously, in some examples the toe boxes 240 and 470 create an "enclosed" or sealed space within the cab 122.

The screws 800A-800N, or whatever technology is used to removably affix the toe box 470 to the cab 122, may be used to create a seal between the toe box 470 and the cab 122. In some examples, a seal interface 802, such as gasket, rubber interface, or the like, is provided by which the toe box 470 is sealed to the cab 122. The seal interface 802 may be a deformable plastic or polymer that allows for a surface of the toe box 470 to at least partially seal to a surface of the cab 122. The seal interface 802 in some configurations abuts to at least a portion of the lip 482 described in FIG. 6 to provide the seal. It should be noted that the seal interface 802 is illustrated as being a separate material installed onto a least a portion of the cab 122. However, in some configurations, the seal interface 802 is an integral part of the cab 122 and/or the toe box 470. In some configurations, the seal interface 802 may be disposed on the toe box 470 rather than or in addition to the cab 122.

When the toe box 470 is detached from the cab 122, a tether 804 may be used to attach the toe box 470 to the cab 122. The tether 804 may be a metallic, semi-metallic, cloth, polymer, or other material that maintains a point of attachment of the toe box 470 to the cab 122 when the toe box 470 is detached from the cab 122. Also illustrated in FIG. 10 is alignment eye 806. When the cab 122 is rotated back down to the closed position, such as the position illustrated in FIG. 3 above, the alignment eye 806 can be used to align the position of the cab 122 with the support structure 236 to ensure that the cab 122 is properly aligned and seated onto the support structure 236.

Figure 11:
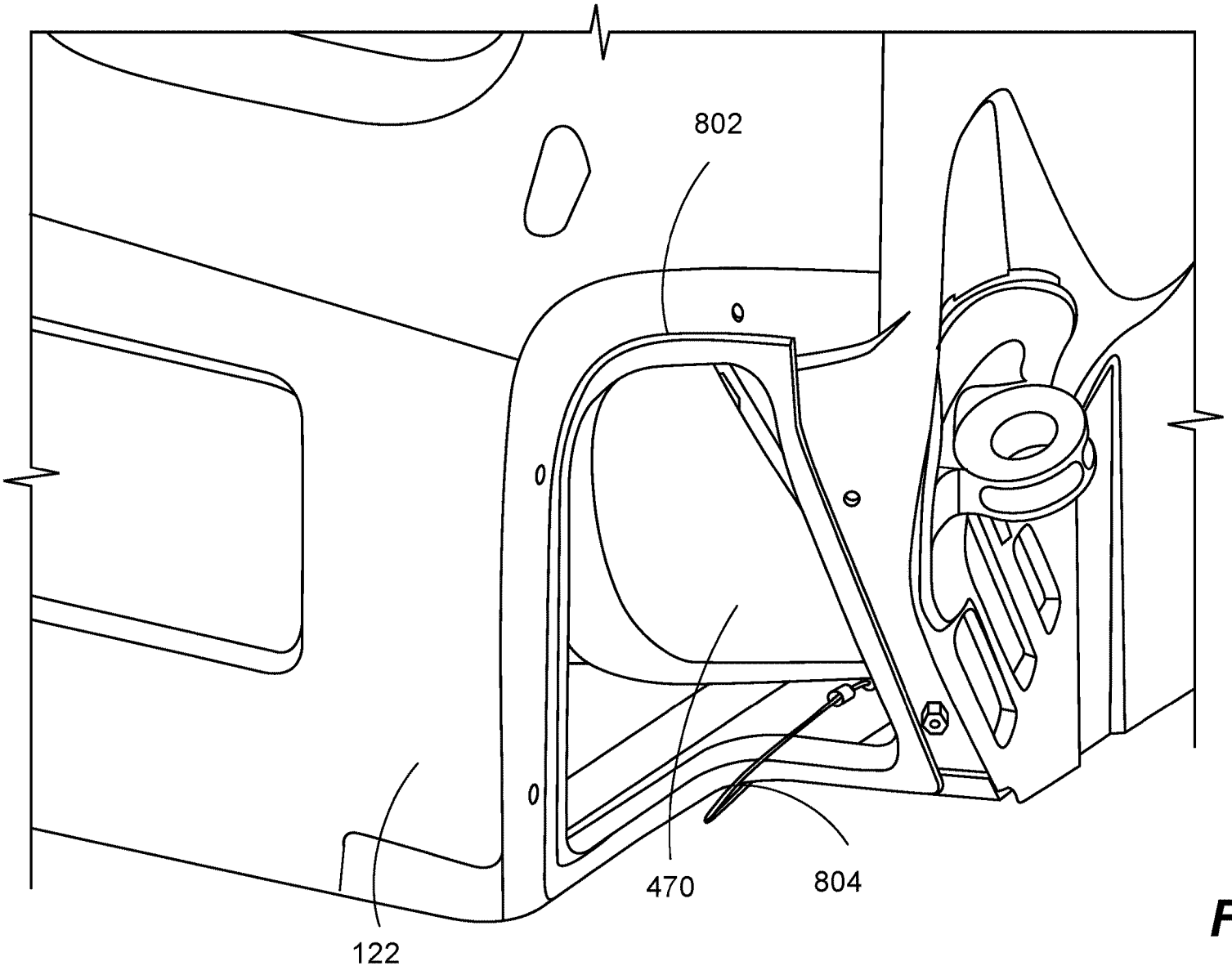
FIG. 11 is a close-up illustration of a toe box detached from a cab but tethered to the cab using a tether, in accordance with one or more examples of the present disclosure.

FIG. 11 is a close up illustration of the toe box 470 detached from the cab 122 (screws 800A-800N have been removed) but tethered to the cab 122 using the tether 804. As noted above, the tether 804 may be a cable, line, or other technology that allows the toe box 470 to be detached from the cab 122, but still secured so that the toe box 470 is not accidentally lost or misplaced. Further, FIG. 11 shows the seal interface 802. When the toe box 470 is detached from the cab 122, the surface of the toe box 470 is no longer sealed to the surface of the cab 122. Thus, in the configuration illustrated in FIG. 11, the cab 122 is no longer a completely sealed cab 122. The cab 122 is thereafter be sealed once the toe box 470 is reattached to the cab 122.

INDUSTRIAL APPLICABILITY

The present disclosure relates generally to the use of removable toe boxes in cabs. In some examples, the benefits of a front tilting cab are provided along with providing additional foot space by the use of removable toe boxes. Various examples of the presently disclosed subject matter provides a system which improves the foot space in a skid steer or a compact track loader cab. Specifically, the system uses a removable panel in the toe/floor area of the cab. The removable panel allows the rotation of cab with the lift arms in the down position and also creates an additional floor space when installed and not rotated. Additionally, the cab can be tilted with the lift arms in the raised position without removing the panel. The system improves the sealing performance compared to a two-part cab.

The use of a removable toe box can increase the amount of space proximate to the feet of an operator of a machine. However, the exterior of the toe box may extend far enough to impact or hit a cylinder used to lift a lift arm of the machine. To provide for the benefits of a toe box while still allowing for the rotation of the cab, the toe boxes can be removed. Removing the toe boxes provides a space through which equipment such as the cylinder can travel through as the cab is rotated. Thus, using the technologies and systems described herein can provide not only an increase in operator comfort, which may increase operational time while decreasing fatigue, but allow for the access of the equipment below the cab without having to configure the machine in a potentially dangerous position, such as a lifted lift arm.

For example, in areas in which there may be a lot of dust or dirt, a sealed (or partially sealed) cab 122 can reduce or prevent the probability of dust or dirt entering the cab 122. This can reduce contamination of interior spaces of the cab 122 and provide a more comfortable, cleaner working space for an operator of the machine. In other examples, a sealed (or partially sealed) cab 122 can provide for a conditioned air space inside the cab 122. For example, the cab 122 may be heated or cooled to provide a more comfortable working area for an operator.

Unless explicitly excluded, the use of the singular to describe a component, structure, or operation does not exclude the use of plural such components, structures, or operations or their equivalents. As used herein, the word "or" refers to any possible permutation of a set of items. For example, the phrase "A, B, or C" refers to at least one of A, B, C, or any combination thereof, such as any of: A; B; C; A and B; A and C; B and C; A, B, and C; or multiple of any item such as A and A; B, B, and C; A, A, B, C, and C; etc.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A work machine, the work machine comprising:

a frame defining a horizontal axis and a vertical axis for the work machine, the frame having a left side and a right side with respect to a direction of forward travel of the work machine;

traction devices coupled to the left side and the right side of the work machine;

a lift arm pivotably attached to the frame through a linkage;

a lift arm cylinder pivotably attached to the lift arm and the frame, the lift arm cylinder when extended causing the lift arm to move to a lifted position and when retracted causing the lift arm to move to a lowered position;

a cab rotatably attached to the frame through a hinge, wherein the cab is rotatable from a closed position to an open position; and at least one toe box removably affixed to a portion of the cab, wherein when the cab is rotated while the toe box is attached to the portion of the cab, the toe box rotates with the cab, and when the toe box is detached from the cab, the cab is rotatable from the closed position to the open position without contacting an exterior portion of the lift arm cylinder.

2. The work machine of claim 1, wherein the cab comprises:

a left side wall;

a right side wall;

a ceiling; and a floor, wherein the left side wall, the right side wall, the ceiling, and the floor provide an interior of the cab, wherein the toe box is removable affixed to a portion of the floor of the cab.

3. The work machine of claim 1, further comprising a second toe box removably affixed to the floor of the cab, wherein the toe box is disposed proximate to the left side wall and the second toe box is disposed proximate to the right side wall.

4. The work machine of claim 1, wherein the at least one toe box comprises a side wall connected to a front wall, the front wall extending normally from a distal end of the side wall.

5. The work machine of claim 4, wherein the at least one toe box includes a lip continuously extending out from the side wall and the front wall to provide a location to removably affix the at least one toe box to the cab.

6. The work machine of claim 1, wherein the cab further comprises a seal interface to at least partially seal the at least one toe box to the cab when the at least one toe box is affixed to the cab.

7. The work machine of claim 6, wherein the seal interface comprises a deformable plastic or polymer.

8. The work machine of claim 1 further, wherein the at least one toe box further comprises a tether to tether the at least one toe box to the cab.

9. A cab for use in a machine, the cab comprising:

a left side wall;

a right side wall;

a ceiling;

a floor, wherein the left side wall, the right side wall, the ceiling, and the floor provide an interior of the cab; and a toe box removably affixed to the floor of the cab, wherein when the cab is rotated while the toe box is attached to the floor of the cab, the toe box rotates with the cab, and when the toe box is detached from the cab, the cab is rotatable from the closed position to the open position without contacting an exterior portion of the lift arm cylinder.

10. The cab of claim 9, wherein the toe box comprises a side wall connected to a front wall, the front wall extending normally from a distal end of the side wall.

11. The cab of claim 10, wherein the toe box comprises a lip continuously extending out from the side wall and the front wall to provide a location to removably affix the toe box to the cab.

12. The cab of claim 11, wherein the cab further comprises a seal interface to at least partially seal the toe box to the cab along at least a portion of the lip when the toe box is affixed to the cab.

13. The cab of claim 9, wherein the toe box extends a length of the floor of the cab from a first length to a second length, wherein the second length is greater than the first length.

14. The cab of claim 9, wherein the toe box is removably affixed to a portion of the cab using at least one screw, tab, clamp, button, or clasp.

15. The cab of claim 9, wherein the toe box is tethered to the cab by a tether.

16. The cab of claim 15, wherein the tether is metallic, semi-metallic, cloth, or a polymer.

17. A toe box for use in a cab of a machine, the toe box comprising:

a side wall;

a front wall extending normally from a distal end of the side wall; and a lip continuously extending out from the side wall and the front wall to provide a location to removably affix the toe box to the cab, wherein when the cab is rotated while the toe box is attached to the cab, the toe box rotates with the cab, and when the toe box is detached from the cab, the cab is rotatable from the closed position to the open position without contacting an exterior portion of the lift arm cylinder.

18. The toe box of claim 17, wherein the toe box further comprises a seal interface to at least partially seal the toe box to the cab along at least a portion of the lip when the toe box is affixed to the cab.

19. The toe box of claim 17, wherein the toe box is removably affixed to a portion of the cab using at least one screw, tab, clamp, button, or clasp.

20. The toe box of claim 17, wherein the toe box is tethered to the cab by a tether, wherein the tether is metallic, semi-metallic, cloth, or a polymer.

* * * * *